United States Patent [19]

Andrews

[11] Patent Number: 4,504,017

[45] Date of Patent: Mar. 12, 1985

[54] APPARATUS FOR COMMINUTING MATERIALS TO EXTREMELY FINE SIZE USING A CIRCULATING STREAM JET MILL AND A DISCRETE BUT INTERCONNECTED AND INTERDEPENDENT ROTATING ANVIL-JET IMPACT MILL

[75] Inventor: Norwood H. Andrews, Moorestown, N.J.

[73] Assignee: Norandy, Incorporated, Moorestown, N.J.

[21] Appl. No.: 502,383

[22] Filed: Jun. 8, 1983

[51] Int. Cl.[3] ..... B02C 19/06

[52] U.S. Cl. ..... 241/40; 241/80; 241/152 R

[58] Field of Search ..... 241/5, 39, 40, 29, 152 R, 241/97, 80

[56] References Cited

U.S. PATENT DOCUMENTS

| | | | |
|---|---|---|---|
| 697,505 | 4/1902 | Luckenbach . | |
| 1,935,344 | 11/1933 | Andrews et al. | 83/46 |
| 2,032,827 | 3/1936 | Andrews | 83/46 |
| 2,487,088 | 11/1949 | Andrews | 241/40 |
| 3,348,779 | 10/1967 | Andrews | 241/39 |
| 3,559,895 | 2/1968 | Fay | 241/5 |
| 3,614,000 | 10/1971 | Blythe | 241/5 |
| 3,688,991 | 9/1972 | Andrews | 241/5 |
| 4,018,388 | 4/1977 | Andrews | 241/39 |
| 4,189,102 | 2/1980 | Andrews | 241/5 |
| 4,248,387 | 2/1981 | Andrews | 241/5 |

OTHER PUBLICATIONS

Marcel A. Lissman, Jet Pulverizing Now Practical, May 1938, vol. 45, No. 5.

*Primary Examiner*—Mark Rosenbaum
*Attorney, Agent, or Firm*—Seidel, Gonda & Goldhammer

[57] ABSTRACT

Apparatus for comminuting materials to extremely fine size includes a circulating stream jet mill and a discrete but functionally interconnected and interdependent rotating anvil-jet impact mill. New material is injected into the impact mill against a rotor, and the partly comminuted material is transferred to the jet mill with vortex feed into the jet mill. Uncomminuted material in the jet mill is reinjected into the impact mill. The two mills transfer the material back and forth until the particles are comminuted, classified, and removed from the jet mill. The anvil-jet mill is provided with stationary anvils and support for turning the rotor at increased velocity.

20 Claims, 9 Drawing Figures

FIG.2
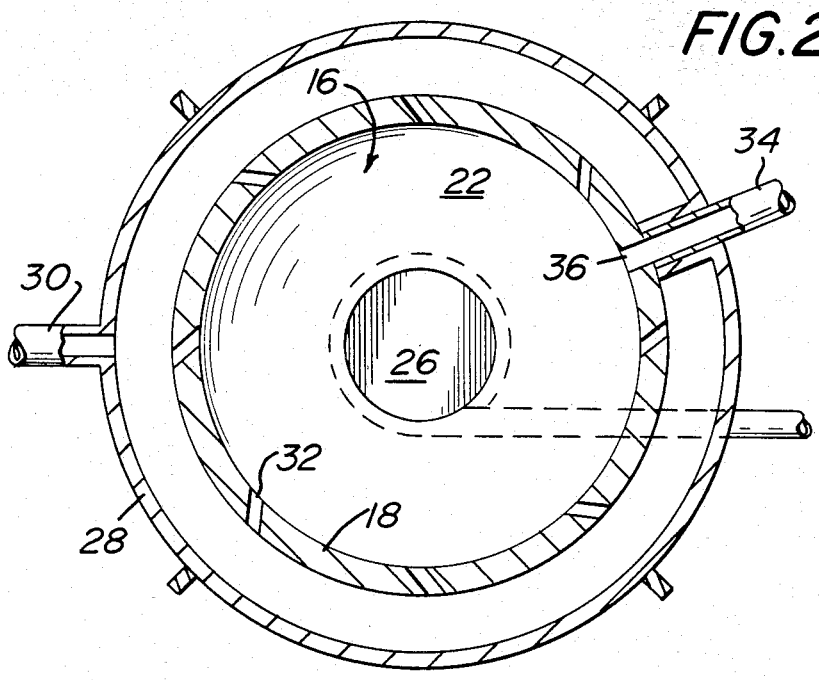
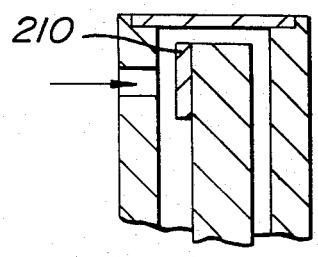
FIG.8
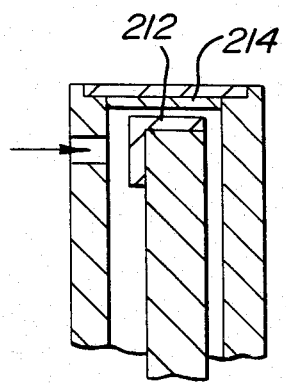
FIG.9

APPARATUS FOR COMMINUTING MATERIALS TO EXTREMELY FINE SIZE USING A CIRCULATING STREAM JET MILL AND A DISCRETE BUT INTERCONNECTED AND INTERDEPENDENT ROTATING ANVIL-JET IMPACT MILL

BACKGROUND OF THE INVENTION

This invention relates to a method and apparatus for comminuting a wide variety of materials to an extremely fine size using a re-entrant circulating stream jet mill and a discrete but interconnected and interdependent jet and rotating anvil-jet impact mill. For the purposes described herein, extremely fine size means particles averaging below 20 microns and, more specifically, below 10 microns including certain specified end products averaging less than 2 microns.

Heretofore, various materials have been comminuted to intermediate average particle size using hammer mills with integral whizzer classifiers, ring roll and bowl mills with integral whizzer classifiers or wet bowl mills. The difficulty with wet bowl mills is that certain material tends to agglomerate when drying and, therefore, requires subsequent breaking up. Regardless, the mill best able to comminute particles to the lowest micron size has been the jet mill of which there have been three basic forms. The first such mill is disclosed in Luckenbach, U.S. Pat. No. 697,505 which uses opposed jet mills. Condensation and classifying problems, however, limited the usefulness of the Luckenbach mill. The next jet mill of any consequence was of the type disclosed in U.S. Pat. No. 1,935,344 and several kindred patents. This type of jet mill is in use today as the so-called "Majac Jet Pulverizer". It is described in its present form in the Fifth Edition of Perry's Chemical Engineering Handbook, Chapter 8, page 44. The Majac mill uses a whizzer type classifier making it superior in operation to the typical jet and anvil mill, such as disclosed in U.S. Pat. No. 2,487,088.

The third and most universally used of all jet type communiting mills for low micron size is the re-entrant circulating stream jet mill disclosed in U.S. Pat. No. 2,032,827 and its prodgeny. This mill is often referred to as a Micronizer.

There have been many attempts to improve upon the Micronizer since it was first introduced, and some of them have been significant improvements. The most successful improvement to the Micronizer for comminuting a wide range of materials is disclosed in U.S. Pat. No. 3,688,991, particularly in columns 7 and 8 and FIGS. 7 and 8. This mill, called the Cyclo-Jet, has been successfully used for the past 10 years for comminuting a wide range of materials with reduced consumption of energy. For example, the mill has been used to comminute talc at an energy cost of approximately 50% of the operating cost of previously known jet type mills.

Not withstanding the success of the Cyclo-Jet, it too has inherent limitation in both its design and operation. To understand these limitations, it is important to note that the Cyclo-Jet is basically a combination of a rotating anvil-jet impact mill and a circulating stream jet mill. Circulating stream jet mills are complex devices despite their apparent simplicity of construction. There are numerous variables which must be balanced or coordinated to achieve the optimum comminution. Some of these variables include the diameter and peripheral height of the grinding and classifying chamber, the number and size of nozzles which in turn depend upon the kind of gas and its pressure, and the angle of the jet stream emitted by the nozzles. Another variable is the shape of the lateral walls which close the grinding and classifying chamber. These can be parallel plates or they can be axially divergent. If the latter, then consideration must be given to the angle of divergence and the radial extent thereof. Other factors include the location and structure of the material feed apparatus as well as the specific gravity and other characteristics of the matrial being fed.

The advantage of the Cyclo-Jet mill disclosed in U.S. Pat. No. 3,688,991 is that the rotating anvil-jet section most efficiently comminutes coarser fractions of material while the circulating stream jet section is best for providing the finest grinding and classification. The problem is that that these two types of mill are not fully compatible when operating in a common grinding and classification chamber. For example, in many instances it is desirable to provide a circulating stream jet mill with diverging walls. This is not possible if the same mill has to include a shaft turning a rotor with anvils at its periphery. Still further, there are problems with supporting the rotor at the distal end of a shaft, as is necessitated by the presence of a centrally positioned outlet in a Micronizer. Experience has shown that distally mounted rotors tend to become unstable, particularly at high rotative velocities. Yet, experience has shown that such velocities are desirable.

As indicated above, it is advantageous in some instances to provide diverging side walls for the grinding and classifying chamber of a circulating stream jet mill. This is not to say that parallel side walls do not have their uses. Parallel walls are preferred for grinding various precipitates and spray dried agglomerates. However, by and large diverging side walls are to be preferred.

It is has been known for some time that the operation of a mill is improved by increasing the quantity of gas swirling within the grinding and classifying chamber. This is accomplished by providing diverging side walls. The amount of divergence is least for high specific gravity materials and greatest for low specific gravity materials. The amount of divergence is greatest at or adjacent the axis of the mill. FIG. 2 of U.S. Pat. No. 3,559,895 is a good illustration of a preferred form of circulating stream jet mill with diverging lateral walls.

A Cyclo-Jet type mill such as illustrated in U.S. Pat. No. 3,688,991 has not yet successfully been provided with diverging walls and rotating disc and anvils. This inventor built a structure similar to the mill illustrated in FIG. 2 of U.S. Pat. No. 3,559,895 but with a 24 inch dish shaped rotor like the lower lateral wall in FIG. 2 of that patent. The rotor proved to be dynamically unstable, probably because of the great peripheral weight of the anvils. The rotor was modified to make it hollow approximately four inches radially outward from the shaft, but the vibration cracked the welds and the experiment was abandoned.

In addition to unstable rotors, the Cyclo-Jet mill does not permit the use of anvils fixed on the peripheral wall of the chamber. This inventor tried welding ribs on the inner periphery of the chamber. This is sound practice in some impact mills, but is was counterproductive in the Cyclo-Jet mill because it interfered with classification of the finally comminuted product. The static anvils slowed the rotational velocity of the material laden gases at the periphery thus nullifying the increased gas velocity generated by the anvils on the rotor. See, for example, column 4, lines 3–15 of U.S. Pat. No. 3,348,799 for a description of how the anvils on the periphery of a rotor assist in increasing the overall efficiency of a mill.

In general, rotating anvil-jet impact mills comminute to finer particle size at higher rotor velocities. Although all materials do not require the same anvil speed for a desired average particle size, velocity tests using a 24 inch rotor with anvils on the periphery are significant. A Cyclo-Jet mill was modified so that the rotor could be turned at velocities of 2,000, 3,600, 4,000 and 4,500 revolutions per minute. The product quality increased with increasing rotor velocity. However, the rotor showed signs of instability at 4,500 r.p.m. Today, approximately 4,000 r.p.m. is about the maximum rotor velocity in commercial use for a 24 inch mill. Of course, higher velocities are possible for mills having smaller rotor diameters. The maximum speed for a six inch mill is 12,000 r.p.m.; for a 12 inch mill it is 8,000 r.p.m.; and a 20 inch mill can operate at 4,500 r.p.m. These rotational velocities convert into peripheral (anvil) velocities of approximately 18,000 feet per minute for the six inch mill, 25,000 feet per minute for a 12 inch mill, 23,000 feet per minute for a 20 inch mill, and 25,000 feet per minute for a 24 inch mill. These velocities cannot be achieved using a dished rotor with anvils, because as indicated above with respect to the modified mill of FIG. 2 of U.S. Pat. No. 3,559,895, the rotor becomes highly unstable at those speeds.

Yet another problem with the Cyclo-Jet is that it cannot take advantage of improvements which have been made in the manner of feeding material into the circulating stream jet part of the mill. For a discussion of the problems encountered in feeding this type mill, see U.S. Pat. No. 4,018,188 and 4,189,102. FIG. 1 of the latter patent illustrates a conical chamber dependent from one of the side walls of the grinding and classifying chamber. This conical chamber creates a vortex of material and injection gas which is merged with the gaseous vortex within the grinding and classifying chamber at approximately the jet tangent circle. In this manner the fluid carrying the feed material assists rather than detracts from the velocity of the main vortex. See also, U.S. Pat. No. 4,428,387 which illustrates modifications of the same concept.

Again, the Cyclo-Jet cannot be adopted to use these improved material feed means because the presence of both the rotor and the feed means would leave no place for a centrally positioned outlet.

The present invention is directed to providing a method and apparatus for communuting materials to extremely fine sizes while overcoming the aforesaid limitations found in the Cyclo-Jet, yet retaining all of its benefits.

SUMMARY OF THE INVENTION

The present invention is directed to a method and apparatus for comminuting materials to extremely fine size using a circulating stream jet mill and a discrete but innerconnected and interdependent rotating anvil-jet impact mill which overcomes the above-described limitations of the Cyclo-Jet mill to provide a mill with increased efficiency and a broadened field of application. In accordance with the present invention, a jet feed means injects new material to be comminuted into the impact mill against a rotor or its anvils. Thereafter, the thus partly comminuted material flows from a tangential port in the impact mill into a discrete re-entrant circulating stream jet mill by means of a vortex feed. The material is comminuted in the circulating stream jet mill with the finer fractions being classified and removed. However, the larger fractions are transferred back to the impact mill through a port in the peripheral wall of the circulating stream jet mill. From that port the material flows to jet injection means where it is reinjected against the rotor or its anvils in the impact mill. The two mills transfer the material back and forth until the particles are comminuted to an extremely finer size and then removed in accordance with the classification principles by which the circulating stream jet mill operates.

The re-entrant circulating stream jet mill may be provided with diverging lateral walls to enhance its comminuting capability. Moreover, the mill is provided with a feed mechanism of the type which creates a vortex for feeding material to be ground into the circulating vortex within the grinding and classification chamber in the vicinity of the jet tangent circle. The comminuting capability of the rotating anvil jet impact mill may be enhanced by providing stationary anvils at preferred locations on the peripheral wall of the casing. Still further, the present invention provides for more stable rotor design whereby increased anvil velocity can be obtained for improved comminuting capability in the impact mill.

The foregoing and other features of the apparatus and its method of operation described below comminute particles to extremely fine size with an efficiency and overall quality which heretofore has not been achieved.

For the purpose of illustrating the invention, there is shown in the drawings a form which is presently preferred; it being understood, however, that this invention is not limited to the precise arrangements and instrumentalities shown.

FIG. 2 is a sectional view of the circulating stream jet mill of FIG. 1 taken along the line 2—2 in FIG. 1.

FIGS. 8 and 9 illustrate alternative anvil structure.

DETAILED DESCRIPTION OF THE INVENTION

Figure 1:
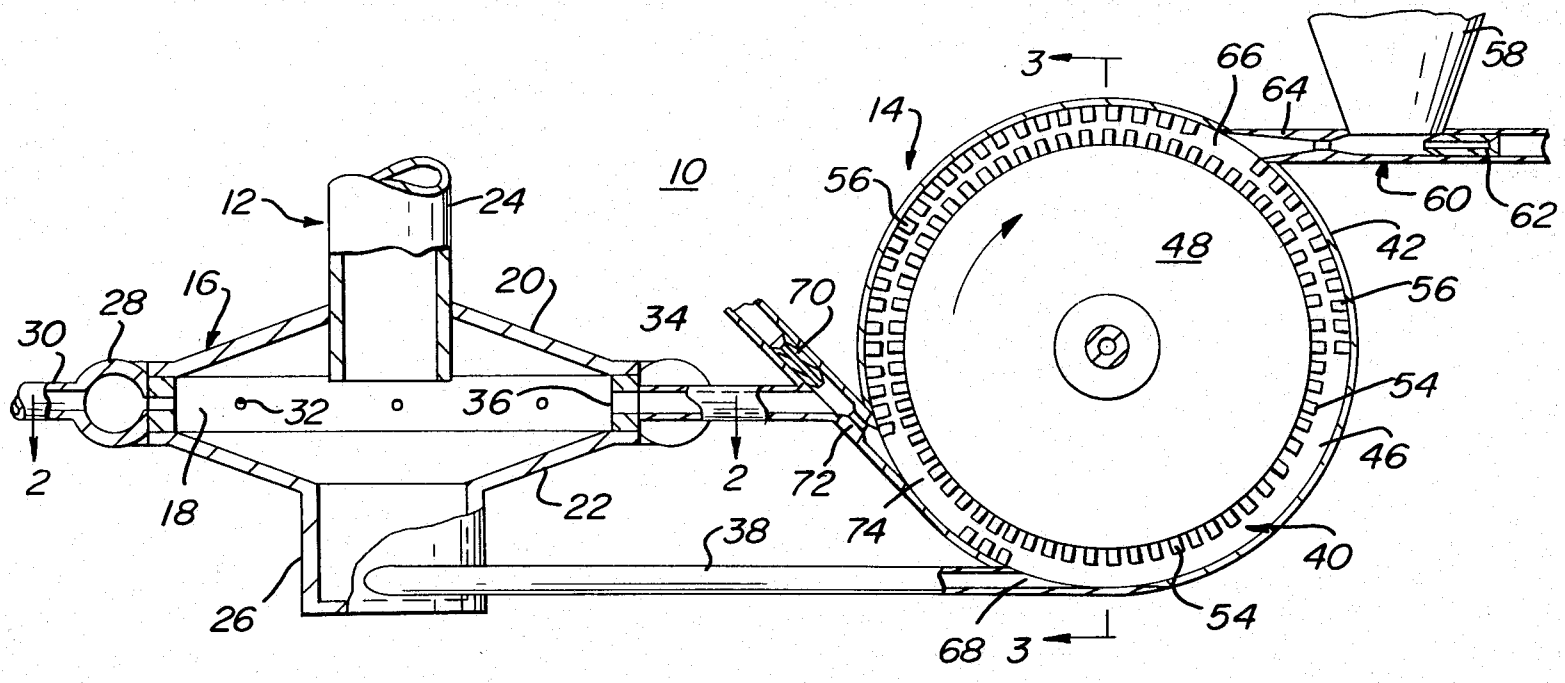
FIG. 1 is a plan view partly in section illustrating one embodiment of the present invention.
Figure 3:
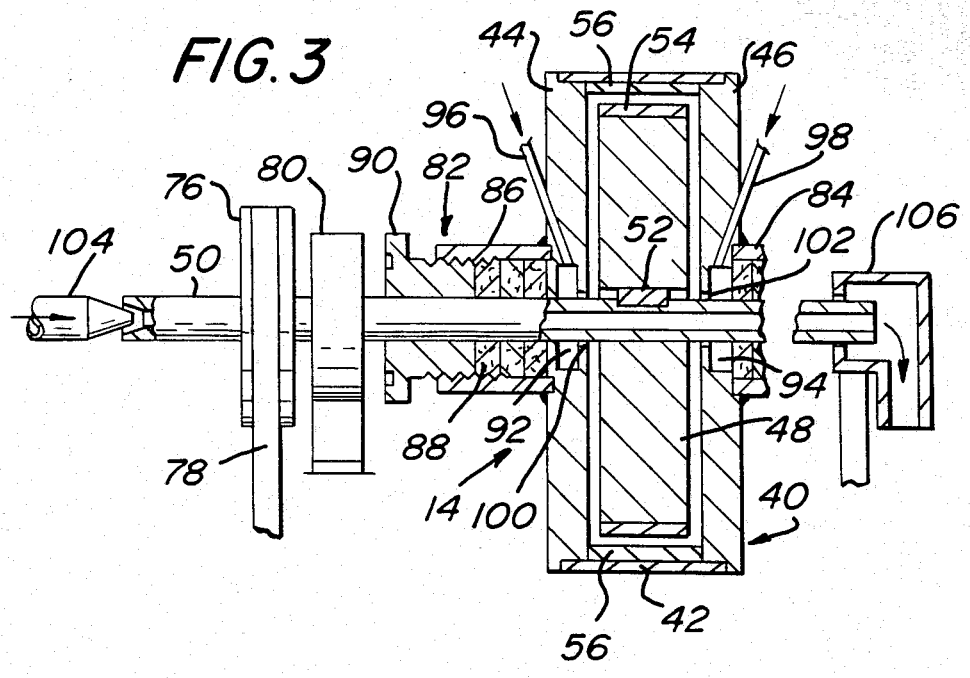
FIG. 3 is a transverse sectional view of the impact mill taken along the line 3—3 in FIG. 1 showing the support, drive and bearing structure.

Referring now to the drawings in detail, where like numerals indicate like elements, there is shown in FIGS. 1, 2 and 3, an apparatus 10 for comminuting materials to extremely fine size using two interconnected and interdependent mills comprising first a reentrant circulating stream jet mill 12 and second a rotating anvil impact mill 14.

The re-entrant circulating stream jet mill 12 is generally the type known as an Micronizer and operates in accordance with the principles applicable to such mills except as hereinafter described. The circulating stream jet mill 12 includes a circular grinding and classifying chamber 16 defined by the annular peripheral wall 18 and opposed lateral walls 20 and 22. The walls 18, 20 and 22 are preferably held together with clamps or like devices for ready disassembly and cleaning. As illustrated, the lateral walls 20 and 22 diverge away from each other with the distance of greatest divergence being radially inward from the periphery toward the axis of the mill 12. The walls 20 and 22 diverge continuously from the peripheral wall to until they join the outlet 24 and the feed chamber 26 respectively. However, as described below, other configurations for the lateral wall can be used.

The outlet 24 is a cylindrical duct for the finished material together with some of the fluid gases flowing within the chamber 16. The duct 24 extends through the lateral wall 20 and its opening is preferably coaxial with the axis of the chamber 16.

Surrounding the annular peripheral wall 18 is an annular manifold 28 connected through the duct 30 to a source (not shown) of gaseous fluid under pressure such as steam.

A plurality of nozzles 32 are spaced at regular intervals around the entire peripheral wall 18. Each of the nozzles 32 is directed at an angle to the radius of the chamber 16 so that the fluid jet streams flowing from them move with both a forward and a radial component of direction. Thus, as is known in jet comminuting technology, the nozzles create a circulating vortex within the chamber 16. A duct 34 is connected through the manifold 28 to an opening 36 in the peripheral wall 18. This duct provides for the flow of partly comminuted material from the comminuting and classifying chamber 16 to the jet and rotating anvil impact mill 14 as explained in more detail below.

As indicated above, the mill 12 is also provided with a vortex feed means 26 which comprises a cylindrical feed chamber closed at one end and opening into the apex of a lateral wall 22 at the other end. Although the feed chamber 26 is illustrated as cylindrical, it should be understood that it can assume other shapes, such as frusto-conical, provided that it has a circular cross-section. As illustrated, a duct 38 is connected to the peripheral wall of the feed chamber 26. Duct 38 conducts partly comminuted material from a port in the rotary anvil impact mill 14 into the feed chamber 26. The duct 38 is connected so that material flows into the feed chamber 26 in a direction that is generally tangential to the peripheral wall. In this manner, a vortical flow is created within the feed chamber 26.

The rotating anvil-jet impact mill 14 comprises a chamber 40 which includes an annular peripheral wall 42 closed by opposed lateral side walls 44 and 46. Mounted within the chamber 40 is a rotor 48 fixed to the shaft 50 by a key 52. A plurality of individual anvils 54 are fixed to the periphery of the rotor 48. As shown in FIG. 1, the anvils 54 are uniformly spaced around the outer periphery of the rotor 48 so that it is rotationally balanced. Although the anvils illustrated in FIGS. 1 and 3 are mounted only on the outer periphery of the rotor 48, it should be understood that in certain circumstances it may be desirable for the anvils to take different shapes and extend at least partly along the surface of the rotor in a radial direction as explained below.

A plurality of regularly spaced stationery anvils 56 are positioned around the periphery of the annular wall 42 so as to be in opposed relation to the rotating anvils 54. The anvils 56 are not positioned along the entirety of the peripheral wall 42 for reasons explained below.

The rotating anvil-jet impact mill further includes jet feed apparatus for feeding raw, uncomminuted material. The jet feed apparatus comprises a funnel 58 which is mounted on the nozzle and venturi mechanism 60. Material is fed in the conventional manner in that it flows from the funnel 58 and is entrained by the carrier fluid emitted from the nozzle 62 connected to a source of high pressure gaseous fluid (not shown). The fluid and raw material are injected into a venturi passage 64 where they are accelerated and flow into the chamber 40. The feed mechanism 60 is mounted on the peripheral wall 42 so that material is directed into the feed chamber in opposition to the direction of rotation of the anvils 56. Specifically, fluid and material is directed generally tangential to the periphery of the rotor 48 and thus against the anvils 54. Thus, initial comminution occurs in the impact zone marked 66.

It should be noted that the rotating anvils 54 also function as vanes for driving the gaseous fluid and entrained raw and partly comminuted material within the chamber 40. The centrifugal force imparted to the material tends to keep it adjacent the peripheral wall 42 and thus causes it to impact against the anvils 56. In addition, the material tends to flow in opposition to the direction of flow of the raw material emitted from the venturi 64. Thus, further comminution occurs as the material within chamber 40 impacts against raw material entering the chamber.

The peripheral wall 42 is provided with a tangential port 68 to which is connected the duct 38. Still further, no anvils 56 are provided on the peripheral wall 42 for a substantial distance ahead of the port 68. Consequently, a certain portion of gaseous fluid and material can flow out of the chamber 40 through the duct 38 into the feed chamber 26.

As previously indicated, partly comminuted material flows from the chamber 16 through duct 34 back into the rotating anvil impact mill 14. It is accelerated into the mill 14 by means of a jet injection apparatus which comprises the nozzle 70 connected to a source of gaseous fluid (not shown) and the venturi 72. The duct 34 is connected between the nozzle 70 and venturi 72 so that the partly comminuted material is entrained in the gas emitted by nozzle 70. It is thereafter accelerated in the venturi 72 and carried into the chamber 40 against the rotating anvils 54 on rotor 48. As shown, the venturi 72 is connected at an angle to the radius of peripheral wall 42. Accordingly, the material flows into the chamber in a direction tangent to the periphery to the rotor 48 and it impacts against the rotating anvils 54 as well as any material flowing around the chamber 40 adjacent the peripheral wall 42. Thus, further comminution takes place by impact against the anvil or against material within the chamber 40 in the zone 74.

One advantage in providing a discrete rotating anvil-jet impact mill is the capability of higher rotor and anvil velocities by improving the support and drive structure for the shaft and rotor. Such an improved structure is illustrated in FIG. 3. As shown, the shaft 50 is keyed to a pulley 76 driven by a belt 78 connected to a motor. The shaft 50 is supported by bearings on both sides of the chamber 40 of which only bearing 80 is illustrated inasmuch as the bearing on the opposing side is structurally the same. The shaft 50 extends through stuffing boxes 82 and 84. Only stuffing box 82 is illustrated in complete form inasmuch as stuffing box 84 is structurally the same except it is positioned on the opposite side of chamber 40.

Stuffing box 82 includes a flange 86 bolted, welded or otherwise fixed to the lateral wall 44. Flange 86 is provided with a plurality of conventional, heat-resistant packings 88 which are sealed into the box by means of a threaded gland 90.

This structure provides support on both sides of the rotor and hence allows higher velocities.

One of the difficulties with operating a rotating anvil jet impact mill is the tendency of the gas and material, which are above atmospheric pressure, to flow out of the mill along the drive shaft. This causes wear, particularly in the stuffing box, loss of stability, and difficulty in maintaining appropriate system pressure. To prevent this, each of the lateral walls 44 and 46 is provided with a open annular channel 92 and 94. Each of the channels surround the shaft 50 and is connected to a pipe 96 and 98 respectively. Each of the pipes 96 and 98 is connected to a source of low pressure air. Still further, each of the channels 92 and 94 opens into the interior of the chamber 40 as indicated at 100 and 102. This allows low pressure gas to flow into the chamber without interfering with the flow of fluid and material within the chamber but at the same time preventing material and fluid from flowing along the shaft 50 thereby reducing the wear on the stuffing box.

Another advantage of the design illustrated in FIG. 3 is that a hollow, water-cooled shaft can be provided. The structure shown in FIG. 4 of U.S. Pat. No. 3,688,991 operates at slow speeds but is inoperative at effective comminuting speeds, probably because the rotor and its shaft cannot be both statically and dynamically balanced. In accordance with the design in FIG. 3, the shaft can extend entirely through the casing 40 and be supported by bearings on both sides thereof. Still further, a nozzle 104 can provide cooling fluid, such as water, which flows through the shaft 50 and drains through the drain 106. Thus, the embodiment illustrated in FIG. 3 provides a means for further improving the operation of the mill by cooling the stuffing box and other parts affected by heat. This may be particularly useful when steam is used as a gaseous fluid for carrying the material to be comminuted.

In the operation of the comminuting apparatus illustrated in FIGS. 1, 2 and 3, raw material is fed from the funnel 58 into the rotating anvil jet impact mill 14 where it is partly comminuted by impact against the rotating anvils 54. Typically, the anvils 54 are spaced approximately ¼ inch apart but this distance can be adjusted depending upon the materials being comminuted. Depending upon the pressure of the gas being used, some of the partly ground material flows out of mill 14 through duct 38 into feed chamber 26. There it flows in a vortical manner and is fed into the comminuting vortex within grinding and classifying chamber 16. The material is introduced at a point of low internal pressure and in a direction whereby it assists rather than detracts from the velocity of the operating vortex within chamber 16.

The re-entrant circulating stream jet mill 12 operates in accordance with the general principles for such mills. As indicated above, it is provided with diverging lateral walls 20 and 22. It should be noted that the rotating anvils 54 act in the manner of fan blades to increase the velocity of the material-laden gas passing through duct 38 and into feed chamber 26. Thus they enhance the operation of feed chamber 26. The diverging walls 20 and 22 enhance the efficiency of the mill 12 by permitting an increased quantity of gas to flow within chamber 16.

Material which has been comminuted to extremely fine size flows out through the outlet 24. Material which is partly comminuted flows through port 36 and duct 34 into the space between jet 70 and venturi 72. At that point it is aspirated into the fluid, gas escaping from jet 70 and accelerated back into the mill 14. The material impacts the rotating anvils 54 and merges with the initial feed material and then returns as a thoroughly mixed feed and partly ground material to the feed chamber 26 as described above.

The flow of material between mill continues until it has been comminuted to an extremely fine size. As indicated above, extremely fine size can be taken to be average particle sizes below 20 microns and, in most instances, below 10 microns. Indeed, for certain products it can be taken to mean particle sizes of less than 2 microns.

A specific advantage of the present invention is that it permits the mill 12 to be designed for optimum rotor speed independent of the size of the mill 12. Specifically, it allows even the smallest circulating stream jet mills to be used with rotating anvil-jet impact mills having maximum desireable anvil velocity. By way of example, a 24 inch circulating steam jet mill can be used with a 48 inch rotating anvil jet mill. This means that the rotor can revolve at half the revolutions per minute to achieve the same anvil velocity. This reduces wear and maintenance of the stuffing boxes as well as the bearings. This is particularly useful when comminuting spray dried and certain precipitated materials where velocities of 800 feet per second or greater provide improved comminution over lower velocities.

Another advantage of having a discrete rotating anvil jet impact mill is the ability to use anvils 56 fixed to the inner periphery of the wall 42. Although this is sound practice in some impact mills, it is counter-productive if used in a Cyclo-Jet for producing finely classified product. Apparently, static anvils slow the rotational velocity of the material laden gases at the periphery and interfere with the speed of the classifying vortex.

Figure 4:
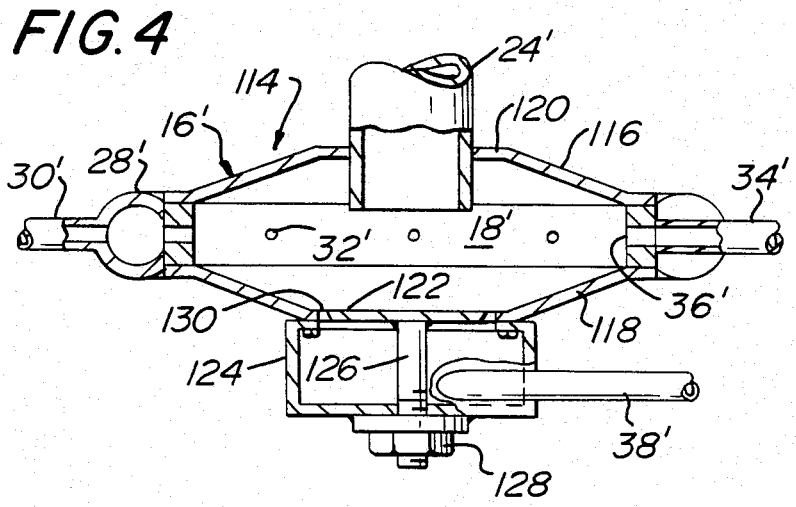
FIG. 4 is a vertical sectional view of another embodiment of the circulating stream jet mill.

Referring now to FIG. 4, there is shown another embodiment of the present invention. Specifically, FIG. 4 illustrates a modified form of the re-entrant circulating stream jet mill designated 114. This mill is believed to be a preferred embodiment of circulating stream jet mill for use with a rotating anvil jet mill such as the mill 14 shown in FIG. 1.

Only the parts of mill 114 which differ from the mill 12 are described in detail. Those parts of the mill 114 which are the same are indicated by the same number but with a prime associated therewith. Except where necessary for purposes of clarity, they will not be specifically referred to.

The chamber 16' is closed by opposed lateral walls 116 and 118 which are divergent as illustrated. The point of greatest divergence is radially inward of the peripheral wall 18'. However, as illustrated, lateral walls 116 and 118 include plane parallel portions indicated as 120 for the wall 116 and 122 for the wall 118.

Planar portion 122 of lateral wall 118 is positioned in the opening of feed chamber 124 which is cylindrical and functions in the same manner as feed chamber 26 in the embodiment of FIG. 1. Planar portion 122 is therefore a disk supported by a threaded post 126 bolted to the bottom of feed chamber 124 by nut 128. Planar portion 122 is smaller in diameter than the opening of feed chamber 124 so as to provide a narrow annular opening into the mill proper. Feed material flows through this narrow circular opening 130 into the interior of chamber 16'. Opening 130 is adjacent the circular jet tangent area for desirably feeding material from feed chamber 124. This arrangement is superior to the multiple feeding parts shown in U.S. Pat. Nos. 2,032,827 and 3,559,395.

Mill 114 is a preferred form of re-entrant circulating stream jet mill which may be used with the rotating anvil jet mill of FIG. 1 or other embodiments thereof described herein.

As indicated above, certain types of precipitated materials, as for example, titanium dioxide pigment and many spray-dried materials, are most effectively comminuted when the jets in the circulating stream jet mill entrain the partly ground material and scrub it along the lateral side walls. This scrubbing action comminutes the material by shear force in much the same manner that chalk is deposited on a chalk board. To be effective, the lateral side walls must be relatively close together because it is the expanding gas from the jets which provide this scrubbing or shearing action. The present invention provides an improved mill for comminuting of materials of the type which scrubbed along the surface of the lateral side walls. This is illustrated by reference to FIG. 5.

Figure 5:
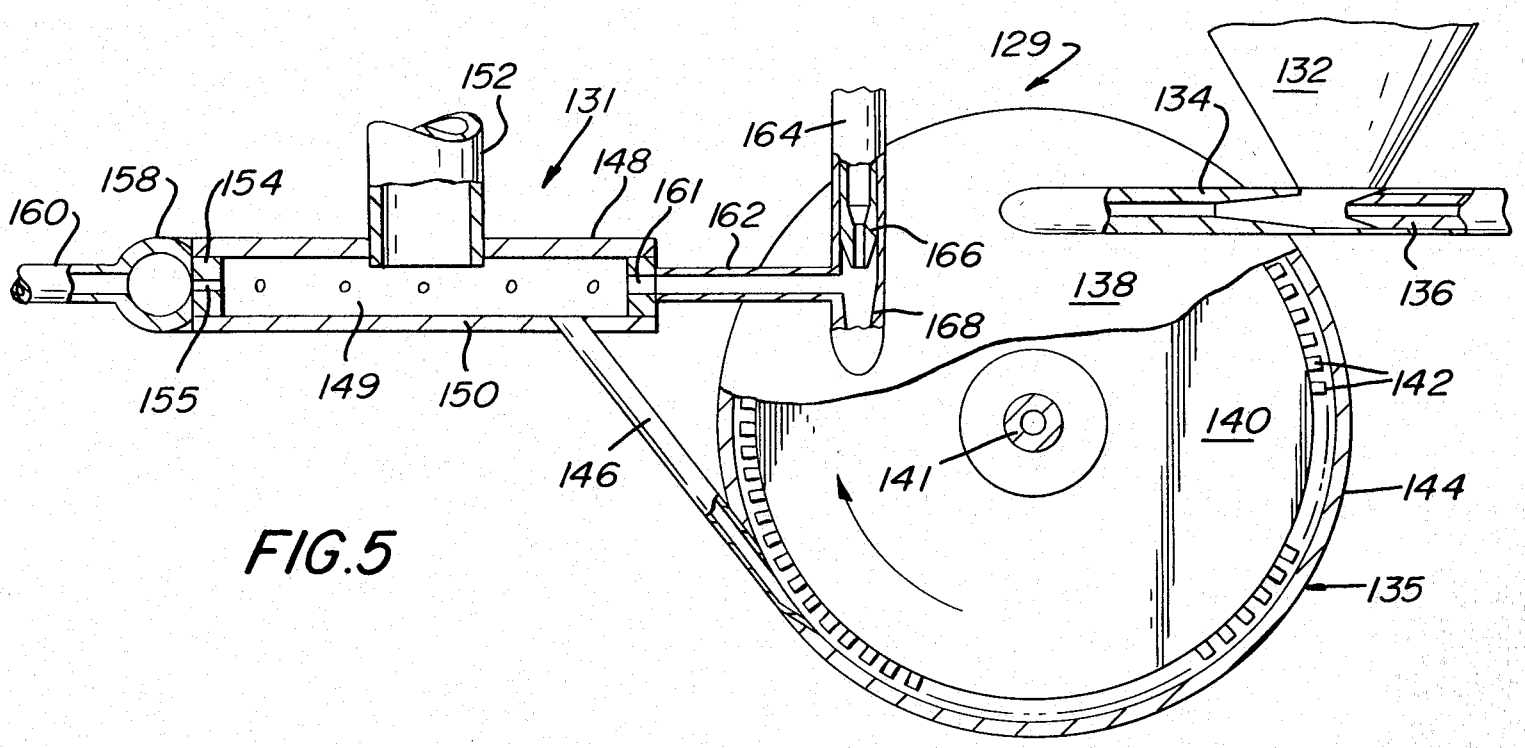
FIG. 5 is a plan view, partly in section, showing yet another embodiment of the present invention.

As shown in FIG. 5, the comminuting apparatus includes a rotating anvil-jet stream mill 129 interconnected with a re-entrant circulating stream jet mill 131. Raw material is fed into the mill 129 from the funnel 132. Gaseous fluid from an appropriate source flows through nozzle 136. The gaseous material aspirates the raw material from funnel 132 and accelerates it in venturi 134. As shown, the venturi 134 is connected to the lateral wall 138 of chamber 135 at a position that is radially inward from the annular peripheral wall 144. Thus, the material is accelerated at an angle against the planar surface of rotor 140. This provides an initial scrubbing action.

Rotor 140 is mounted on shaft 141. A plurality of anvils 142 are spaced at even intervals around the periphery of rotor 140. No fixed anvils are provided on the interior of annular wall 144 inasmuch as a shearing action for comminution is preferred.

Material flowing within the chamber 135 is carried through duct 146 into the chamber 149. The material flows through the lateral wall 150 rather than into a feed chamber. The material is fed into the chamber adjacent the so-called jet tangent zone.

The mill 131 includes an annular peripheral wall 154 with jets 155 connected to the manifold 158. Manifold 158 is connected to an appropriate source of gaseous fluid through duct 160. The lateral walls 148 and 150 are spaced through their radial extent so that the expanding jet laden with material scrubs both walls at the jet tangent circle. This point is chosen because the scrubbing effect would be minimized radially inward of the jet tangent circle whee only the finer fractions circulate. An outlet duct 152 is axially positioned in wall 148.

Peripheral wall 155 is provided with a tangential outlet 161 connected to duct 162. Duct 162 is connected to a jet apparatus 164 comprising nozzle 166 and venturi 168. Venturi 168 opens into the chamber 135 of mill 129 at a position spaced radially inward from the periphery of rotar 140. Thus, material flows out of mill 131 through duct 162. It is aspirated into the fluid escaping from nozzle 166 and accelerated against the surface of plate 140 to provide the scrubbing action. The material flows against rotor 140 in a direction opposite to the direction of rotation thereby enhancing the scrubbing action.

It should be noted that the anvils 142 provide little if any comminuting action. Rather, in the embodiment of FIG. 5 they function mainly as fan blades for directing the flow of fluid within the chamber 155 and throughout the rest of the mill. For this reason, the anvils 142 can be made of a lighter construction than if they actually performed an anvil or impact action.

The flow of material to and from each of the mills 129 and 131 is basically the same as the flow of material within the embodiment as illustrated in FIGS. 1–3, and therefore need not be described in detail.

Figure 6:
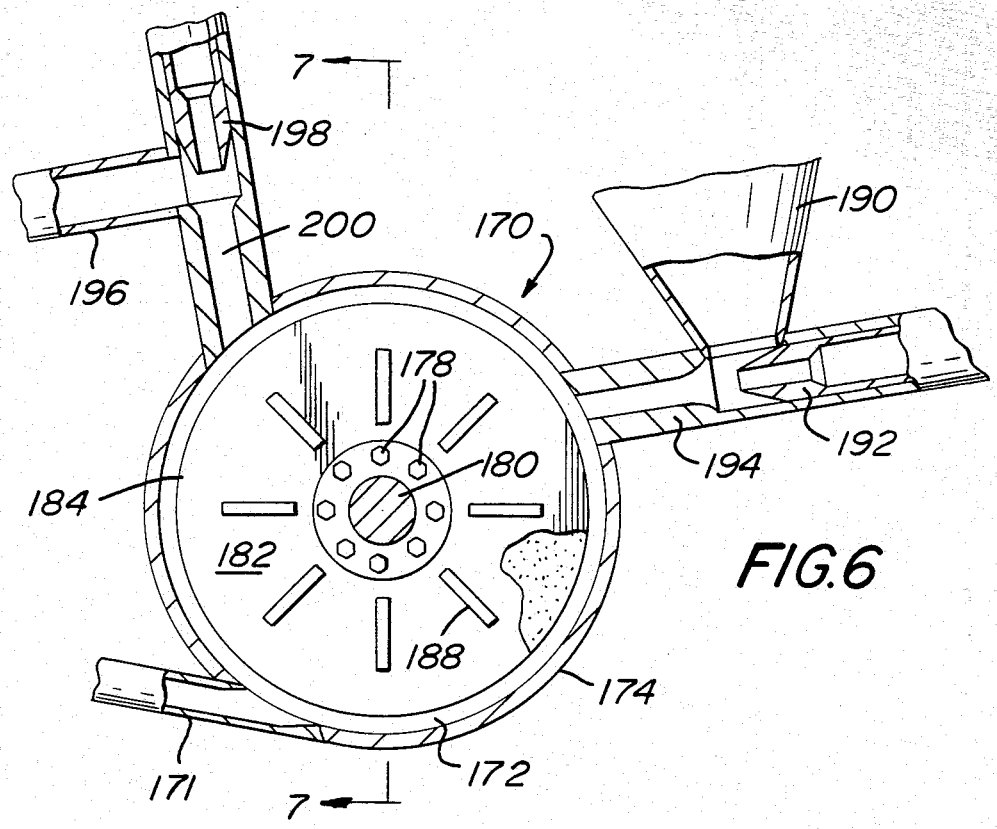
FIG. 6 is a plan view, partly in section, showing another embodiment of the jet and anvil mill for comminuting certain special materials.
Figure 7:
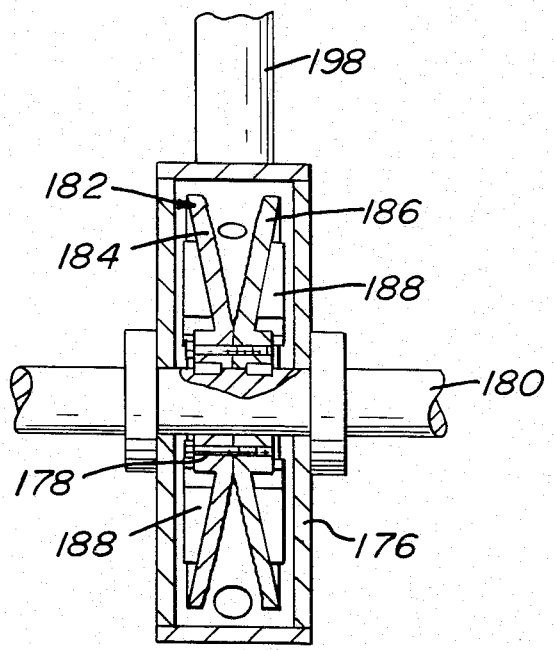
FIG. 7 is a sectional view of the mill illustrated in FIG. 6 taken along the line 7—7.

Although the embodiment of FIG. 5 performs particularly well for comminuting many precipitated materials and some spray-dried materials, it does not do well in comminuting tetrafluoroehylene (TFE) and combinations of TFE and polyethylene. For this purpose, another embodiment of the invention as illustrated in FIGS. 6 and 7 has been provided. This embodiment may use a re-entrant circulating stream jet mill such as is illustrated in FIG. 4 but with a discrete but interconnected rotating anvil jet impact mill as illustrated in FIGS. 6 and 7.

As shown, the mill 170 includes a chamber 172 comprising an annular peripheral wall 174 and lateral side walls 176 and 178. A shaft 180 extends through the chamber 172 and supports a novel rotor 182 which is best illustrated in FIG. 7.

As shown, the rotor 182 comprises two concave discs 184 and 186 fixed to the shaft 180 by key means or the like. The discs diverge away from each other such that they are spaced farthest apart at their peripheries and abut each other adjacent the axis where they are joined to the shaft 180.

Each of the discs 186 and 188 is provided with a plurality of fan blades 188 spaced radially inward from the periphery thereof.

The mill 170 is provided with a feed mechanism comprising the funnel 190, injector nozzle 192 and venturi 194 which function to feed raw material into the chamber through an opening in the peripheral wall 174. The manner of operation of this feed mechanism has been described in respect to other embodiments of this invention and therefore need not be further described. However, it should be noted that the venturi feeds the material through the peripheral wall 174 into the space between the two diverging discs 184 and 186.

Partly ground material is returned from the circulating stream jet mill through the duct 196. It flows into a zone between the injector nozzle 198 and the venturi 200. In this manner, the returning partly comminuted material is aspirated into the fluid gas and accelerated through the venturi into the chamber 172.

As illustrated in FIG. 7, the material flows into the chamber into the space between the two diverging discs 184 and 186.

As best illustrated in FIG. 6, the venturies 194 and 200 direct the fluid and material into the chamber 172 against the direction of rotation of rotor 182. Moreover, their respective openings into the chamber 172 are spaced from each other at an angle of approximately 90° about the peripheral wall 174.

As previously indicated, the discs 184 and 186 are keyed to the shaft 180. Moreover, they are fixed to each other by any conventional means, such as bolts. They diverge from each other at an angle such that they are spaced apart at their periphery adjacent the annular wall 174 by a distance is approximately equal to or slightly greater than the port in the peripheral wall.

By so shaping the discs, maximum advantage can be taken for the shearing action for comminuting materials such as TFE, polyethelyne or mixtures thereof. It has been determined that best results are obtained by using stainless steel for the discs 184 and 186. Still further, best results are obtained by injecting the raw material and the recirculated materials at an angle opposed to the direction of rotation. Thus, the venturi 194 is at an angle such that the material enters the space between the two discs radially outward from the shaft 180 and in a direction opposed to the direction of rotation for the discs. The same is true for the recirculated material entering from venturi 200 but at a different position on the annular wall 174.

A series of tests was made to determine the relative percentage of reduction for TFE and mixtures of TFE and polyethelyne. It was determined that there is a reduction in the amount of energy required to comminate such materials. Further tests were made to determine the relative percentage of comminution in the circulating stream jet mill and the rotating anvil and jet mill. Although no conclusive proof was obtained, it does appear that on an energy basis the largest comminution was in the rotating anvil and jet mill while the circulating stream jet mill contributed mainly to classifying this difficult material.

The embodiments of FIGS. 1–3, 4 and 5 illustrate the anvils as being on the outer periphery of the rotor. However, this is not always necessary. For some embodiments it may be desirable to otherwise position the anvil. In FIG. 8, the anvils 210 are mounted on one surface of the rotor adjacent the periphery thereof. This is useful where the direction of feed is through a lateral wall rather than the peripheral wall.

In FIG. 9 the anvils 212 are on both the face of the rotor and its outer periphery. This is useful where the direction of feed is through a lateral wall but where it is also desirable to use stationary anvils 214 on the peripheral wall.

From the foregoing, it should be apparent that by providing discrete but interconnected and interdependent re-entrant circulating stream and rotating anvil-jet mills, comminuting to extremely fine particle size can be provided. The use of such discrete but interconnected mills for the first time permits comminution to such particle size with increased efficiency by taking advantage of the combined interrelationship between the two mills while simultaneously operating the mills to their best advantage in an independent fashion. Examples include the capability of appropriate rotor and anvil design in the rotating anvil-jet mill and the use of diverging walls in the circulating stream jet mill. Other advantages include the capability of proper feed of the recirculating material in the circulating stream-jet mill and appropriate bearing design for high speeds in the rotating anvil-jet impact mill. of course, other examples of such advantages are described above.

Finally, it should be noted that some but not all of the benefits of this invention may be obtained by not returning partly comminuted material to the rotating anvil jet mill.

The present invention may be embodied in other specific forms without departing from the spirit or essential attributes thereof and accordingly, reference should be made to the appended claims, rather than to the foregoing specification, as indicating the scope of the invention.

I claim:

1. Comminuting apparatus comprising:

(a) a discrete re-entrant circulating stream jet mill;

(b) a discrete rotating anvil-jet impact mill;

(c) said circulating stream jet mill and said rotating anvil-jet impact mill being functionally interconnected to comminute material to extremely fine sizes;

(d) said re-entrant circulating stream jet mill comprising a vortex chamber including an annular peripheral wall and opposed lateral walls, an axial outlet, and a vortex feed chamber closed at one end and opening at the other end into one of said lateral walls through an annular opening adjacent the jet tangent circle;

(e) said rotating anvil-jet impact mill comprising an impact chamber including an annular peripheral wall and opposed lateral walls, shaft means extending into said impact chamber and supporting a rotor thereon, said rotor including a plurality of anvils;

(f) raw material feed means for introducing uncomminuted material into said rotating anvil-jet impact mill;

(g) conduit means connecting an opening in the peripheral wall of said rotating anvil-jet impact mill to said vortex feed chamber, said conduit being connected to said impact mill so that material flows therefrom to said vortex feed chamber;

(h) fluid jet means for reinjecting fluid and material into said impact mill against and in a direction opposite to the direction of rotation of said rotor;

(i) second conduit means for connecting an opening in the peripheral wall of said circulating stream jet mill to said fluid jet reinjection means whereby partly ground material flows from the circulating stream jet mill to said reinjection means and is thereby injected into said impact mill.

2. Apparatus in accordance with claim 1 wherein said vortex feed means in partly closed by a disc at the end which opens into said comminuting and classifying chamber, said disc defining the annular opening through which material is fed into said chamber.

3. Apparatus in accordance with claim 1 wherein said jet reinjection means is positioned to direct said material against the rotating anvils on said rotor.

4. Apparatus in accordance with claim 1 wherein said jet reinjection means is positioned to direct said material against the surface of said rotor.

5. Apparatus in accordance with claim 1 wherein said anvils are on the periphery of said rotor.

6. Apparatus in accordance with claim 1 wherein said anvils are on the surface of said rotor adjacent the periphery thereof.

7. Apparatus in accordance with claim 1 wherein said anvils are on the periphery and on the adjacent surface of said rotors.

8. Apparatus in accordance with claim 1 wherein said lateral walls diverge from each other with the greatest distance of divergence being spaced radially inward from the peripheral wall.

9. Comminuting apparatus comprising:

(a) a discrete re-entrant circulating stream jet mill;

(b) a discrete rotating anvil-jet impact mill;

(c) said circulating stream jet mill and said rotating anvil-jet impact mill being functionally interconnected to comminute material to extremely fine sizes;

(d) said re-entrant circulating stream jet mill comprising a vortex chamber including an annular peripheral wall and opposed lateral walls, an axial outlet, and a vortex feed chamber at the axis of said mill opening into one of said lateral walls through an annular opening;

(e) said rotating anvil-jet impact mill comprising an impact chamber including an annular peripheral wall and opposed lateral walls, shaft means extending into said impact chamber and supporting a rotor thereon;

(f) raw material feed means for introducing uncomminuted material into said comminuting apparatus;

(g) conduit means connecting said rotating anvil-jet impact mill to said vortex feed chamber, said conduit being connected to said impact mill so that material flows therefrom to said vortex feed chamber;

(h) fluid jet means for reinjecting fluid and material into said impact mill against and in a direction opposite to the direction of rotation of said rotor;

(i) second conduit means for connecting said circulating stream jet mill to said fluid jet reinjection means whereby partly ground material flows from the circulating stream jet mill to said reinjection means and is thereby injected into said impact mill.

10. Apparatus in accordance with claim 9 wherein said rotor comprises two conical discs joined at their apexes, and said jet reinjection means is positioned to direct material into the channel defined by said two discs.

11. Apparatus in accordance with claim 10 wherein a plurality of regularly spaced fan blades are mounted on said rotor at a position spaced radially inward from the periphery of said rotor.

12. Comminuting apparatus in accordance with claims 1 or 9 wherein said shaft means extends through said impact chamber, is supported on opposite sides of said impact chamber by rotary bearing means, and each of said bearing means includes conduit means for conducting gaseous fluid into said impact chamber where said shaft enters said chamber, whereby material in said chamber is prevented from flowing along said shaft into the bearing means.

13. Apparatus in accordance with claim 9 wherein said rotor includes a plurality of anvils.

14. Apparatus in accordance with claim 13 wherein said anvils are on the periphery and on the adjacent side surface of said rotors.

15. Comminuting apparatus in accordance with claim 13 wherein stationary anvils are positioned on the interior of the annular peripheral wall of said anvil-jet impact mill.

16. Apparatus in accordance with claim 9 wherein said anvils are on the periphery of said rotor.

17. Apparatus in accordance with claim 9 wherein said anvils are on a side surface of said rotor adjacent to periphery of the rotor.

18. Comminuting apparatus in accordance with claim 9 wherein said vortex feed means is partly closed by a disc at the end which opens into said comminuting and classifying chamber, said disc defining the annular opening through which material is fed into said chamber.

19. Apparatus in accordance with claim 18 wherein said annular opening is positioned adjacent to the stream jet tangent circle of said circulating stream jet mill.

20. Comminuting apparatus comprising:

(a) a discrete re-entrant circulating stream jet mill;

(b) a discrete rotating anvil-jet impact mill;

(c) said circulating stream jet mill and said rotating anvil-jet impact mill being functionally interconnected to comminute material to extremely fine sizes;

(d) said re-entrant circulating stream jet mill comprising a vortex chamber including an annular peripheral wall and opposed lateral walls, an axial outlet, and feed means opening into the said chamber at the axis thereof;

(e) said rotating anvil-jet impact mill comprising an impact chamber including an annular peripheral wall and opposed lateral walls, shaft means extending into said impact chamber and rotatably supporting anvil means thereon;

(f) raw feed materials for introducing uncomminuted material into said comminuting apparatus;

(g) conduit means connecting said rotating anvil-jet impact mill to said feed means for said circulating stream jet mill for transferring material from said impact mill to said re-entrant circulating stream jet mill;

(h) fluid jet means for reinjecting fluid and material into said impact mill against and in a direction opposite to the direction of rotation of said rotor;

(i) second conduit means for connecting said circulating stream jet mill to said fluid jet reinjection means for transferring partly ground material from said circulating stream jet mill to said reinjection means for injection into said impact mill.

* * * * *